US005115252A

United States Patent [19]

Sasaki

[11] Patent Number: 5,115,252

[45] Date of Patent: May 19, 1992

[54] THERMAL HEAD DRIVE APPARATUS CORRECTING FOR THE INFLUENCE ON A PRINTING ELEMENT OF HEAT FROM OTHER PRINTING ELEMENTS

[76] Inventor: Eiichi Sasaki, 205 Takahashi-Haitsu, 1994-1 Futoo-cho, Kohoku-ku, Yokohama-shi, Kanagawa-ken, Japan

[21] Appl. No.: 475,898

[22] Filed: Jan. 30, 1990

[30] Foreign Application Priority Data

Feb. 3, 1989 [JP] Japan ..... 1-24922
Oct. 16, 1989 [JP] Japan ..... 1-268628

[51] Int. Cl.[5] ..... B41J 2/36; B41M 5/26

[52] U.S. Cl. ..... 346/76 PH; 358/298; 400/120

[58] Field of Search ..... 346/76 PH; 358/298; 400/120

[56] References Cited

U.S. PATENT DOCUMENTS 4,679,055 7/1987 Inui et al. ..... 346/76 PH
4,816,843 3/1989 Sasaki ..... 346/76 PH

*Primary Examiner*—Benjamin R. Fuller
*Assistant Examiner*—Huan Tran

[57] ABSTRACT

A thermal head drive apparatus drives a plurality of heating resistors arranged in one line in a thermal head using image data to print picture elements every one line. The drive apparatus comprises a correcting device for correcting an influence by accumulated heat of the heating resistors using data for correction as to the image data; a calculator for making data for correcting the influence by the accumulated heat of the heating resistors from the image data and the data for correction; a delay device for delaying data from the calculator by one line; and a calculating section for calculating and providing the data for correction to the correcting device and the calculator based on data from the delay device and data before and after the data from the delay device. The apparatus may comprise a first delay device for delaying the image data by a predetermined number of lines; a first calculator for making data for correction by data from the first delay device and delayed data for correction; a first correcting device for correcting an influence amount by the accumulated heat of the heating resistors as to the image data by the data for correction from the first calculator; and a second delay device for delaying the data for correction from the first calculator by one line and providing these delayed data to the first calculator as the delayed data for correction.

10 Claims, 12 Drawing Sheets

THERMAL HEAD DRIVE APPARATUS CORRECTING FOR THE INFLUENCE ON A PRINTING ELEMENT OF HEAT FROM OTHER PRINTING ELEMENTS

BACKGROUND OF THE INVENTION

1. Field of the Invention

The present invention relates to a thermal head drive apparatus used in a printer, a copying machine. etc.

2. Description of the Related Art

In a general thermal head drive apparatus, a thermal head has a plurality of heating resistors arranged in a line and is driven by using image data. In such a thermal head drive apparatus, image data of an object picture element are corrected to correct an influence of the object picture element on density by heat-accumulating states of the heating resistors. Such a structure is shown in Japanese Patent Application Laying Open (KOKAI) No. 60-131262.

In the above thermal head drive apparatus, the individual heat-accumulating state of the object heating resistor is provided by giving weights in accordance with the positions of the respective picture elements to the image data of the respective picture elements around the object picture element and performing an additional operation with respect to the weighted data. Accordingly, when the image data are binary data, it is possible to calculate the heat-accumulating states of the heating resistors since an information amount of the image data of the picture elements is small. However, when the image data are multivalued data and an image at multiple gradations is printed, it is necessary to calculate the heat-accumulating states of the heating resistors from the image data of the picture elements arranged before a predetermined line in addition to the image data of the picture elements since the image data arranged before the predetermined line give an influence to the density of the object picture element. Accordingly, the information amount becomes very large and the apparatus is large-sized so that it is almost impossible to practice the drive apparatus.

SUMMARY OF THE INVENTION

It is therefore an object of the present invention to provide a thermal head drive apparatus which drives a thermal head by using image data at multiple gradations and has a simple construction and can correct an influence of an object picture element on density by the heat-accumulating states of heating resistors.

The above object of the present invention can be achieved by a thermal head drive apparatus for driving a plurality of heating resistors arranged in one line in a thermal head by using image data to perform a printing operation with respect to picture elements every one line, the apparatus comprising correctıng means for correcting an influence by accumulated heat of the heating resistors using data for correction with respect to the image data; calculating mean for making data for correcting the influence by the accumulated heat of the heating resistors from the image data and the data for correction; delay means for delaying data from the calculating means by one line; and a calculating section for calculating and providing the data for correction to the correcting means and the calculating means on the basis of data from the delay means and data before and after the data from the delay means.

In a second embodiment, the present invention resides in a thermal head drive apparatus for driving a plurality of heating resistors arranged in one line in a thermal head by using image data to perform a printing operation with respect to picture elements every one line, the apparatus comprising first delay means for delaying the image data by a predetermined number of lines; first calculating means for making data for correction by data from the first delay means and delayed data for correction; first correcting means for correcting an influence amount by the accumulated heat of the heating resistors with respect to the image data by the data for correction from the first calculating means; and second delay means for delaying the data for correction from the first calculating means by one line and providing these delayed data to the first calculating means a the delayed data for correction.

In a third embodiment, in the thermal head drive apparatus of the second embodiment, with respect to the image data for performing the printing operation of an object picture element, the apparatus further comprises second correcting means for correcting a thermal influence amount by plural heating resistors before and after a heating resistor for performing the printing operation of the object picture element by plural image data for respectively performing the printing operation of plural picture elements before and after the object picture element.

The thermal head drive apparatus of the second or third embodiment further comprises third correcting means for obtaining data delayed from the image data by one line and plural data before and after these delayed data and correcting the influence amount by the accumulated heat of the heating resistors using the obtained data with respect to the image data.

The thermal head drive apparatus of the second embodiment further comprises second calculating means for calculating a difference in sum of data from the second delay means and plural data before and after the data from the second delay means and providing the calculated difference to the first calculating means. The data for correction are made by the first calculating means using the data from the second calculating means and the data from the first delay means.

In the first embodiment of the present invention, the correcting means corrects an influence by accumulated heat of the heating resistors using data for correction with respect to the image data. The calculating means makes data for correcting the influence by the accumulated heat of the heating resistors from the image data and the data for correction. The delay means delays data from the calculating means by one line. The calculating section calculates and provides the data for correction to the correcting means and the calculating means on the basis of data from the delay means and data before and after the data from the delay means.

In the second embodiment of the present invention, he first delay means delays the image data by a predetermined number of lines. The first calculating means makes data for correction by data from the first delay means and delayed data for correction. The first correcting means corrects an influence amount by the accumulated heat of the heating resistors with respect to the image data by the data for correction from the first calculating means. The second delay means delays the data for correction from the first calculating means by one line and provides these delayed data to the first calculating means as the delayed data for correction.

In the third embodiment of the present invention, with respect to the image data for performing the printing operation of an object picture element, the second correcting means corrects a thermal influence amount by plural heating resistors before and after a heating resistor for performing the printing operation of the object picture element by plural image data for respectively performing the printing operation of plural picture elements before and after the object picture element.

The third correcting means obtains data delayed from the image data by one line and plural data before and after these delayed data and corrects the influence amount by the accumulated heat of the heating resistors using the obtained data with respect to the image data.

The second calculating means calculates a difference in sum of data from the second delay means and plural data before and after the data from the second delay means and provides the calculated difference to the first calculating means. The data for correction are made by the first calculating means using the data from the second calculating means and he data from the first delay means.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a thermal head drive apparatus in the present invention will next be described in detail with reference to the accompanying drawings.

Figure 1:
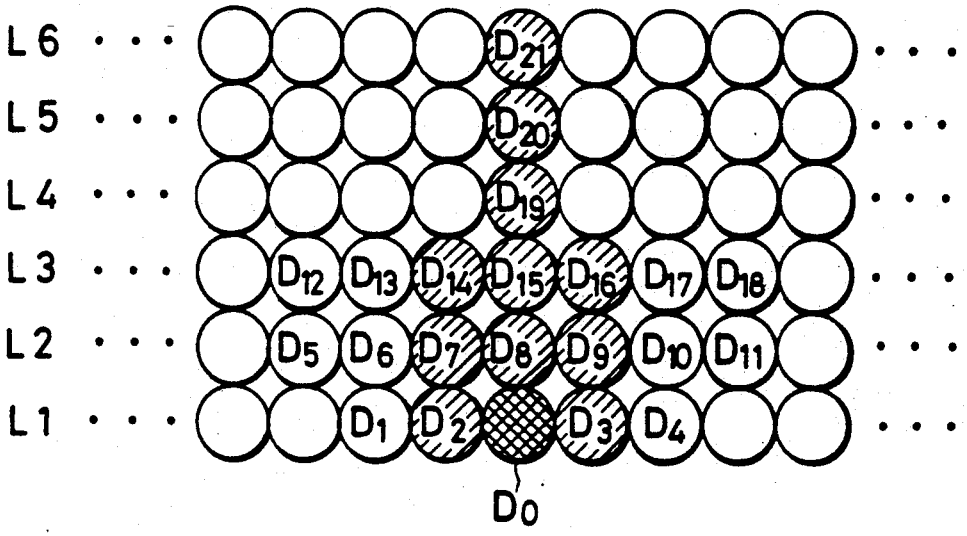
FIG. 1 is a view for explaining a general thermal head drive apparatus.

In a general thermal head drive apparatus, a thermal head has a plurality of heating resistors arranged in a line and is driven by using image data. In such a thermal head drive apparatus, as shown in FIG. 1, a picture element (which is called an object picture element in the following description) $D_0$ is imaged and printed by a certain heating resistor (which is called an object heating resistor in the following description). A plurality of picture elements $D_1$ to $D_{21}$ around the object picture element $D_0$ are ranged from a line L1 including the object picture element $D_0$ to a line L6 arranged before this object picture element by five lines. Individual heat-accumulating states of the above heating resistors are provided by giving weights in accordance with the positions of the respective picture elements $D_1$ to $D_{21}$ to data thereof and performing an additional operation with respect to the weighted data. Image data of the object picture element are corrected by the above added results so as to correct an influence of the object picture element on density by the heat-accumulating states of the heating resistors.

In the above thermal head drive apparatus, the individual heat-accumulating state of the object heating resistor is provided by giving the weights in accordance with the positions of the respective picture elements $D_1$ to $D_{21}$ to the image data of the respective picture elements $D_1$ to $D_{21}$ around the object picture element $D_0$ and performing the additional operation with respect to the weighted data. Accordingly, when the image data are binary data, it is possible to calculate the heat-accumulating states of the heating resistors since an information amount of the image data of the picture elements $D_1$ to $D_{21}$ is small. However, when the image data are multivalued data and an image at multiple gradations is printed, it is necessary to calculate the heat-accumulating states of the heating resistors from the image data of the picture elements arranged before the line L6 in addition to the image data of the picture elements $D_1$ to $D_{21}$ since the image data arranged before the line L6 give an influence to the density of the object picture element. Accordingly, the information amount becomes very large and the apparatus is large-sized so that it is almost impossible to practice the drive apparatus.

Figure 2:
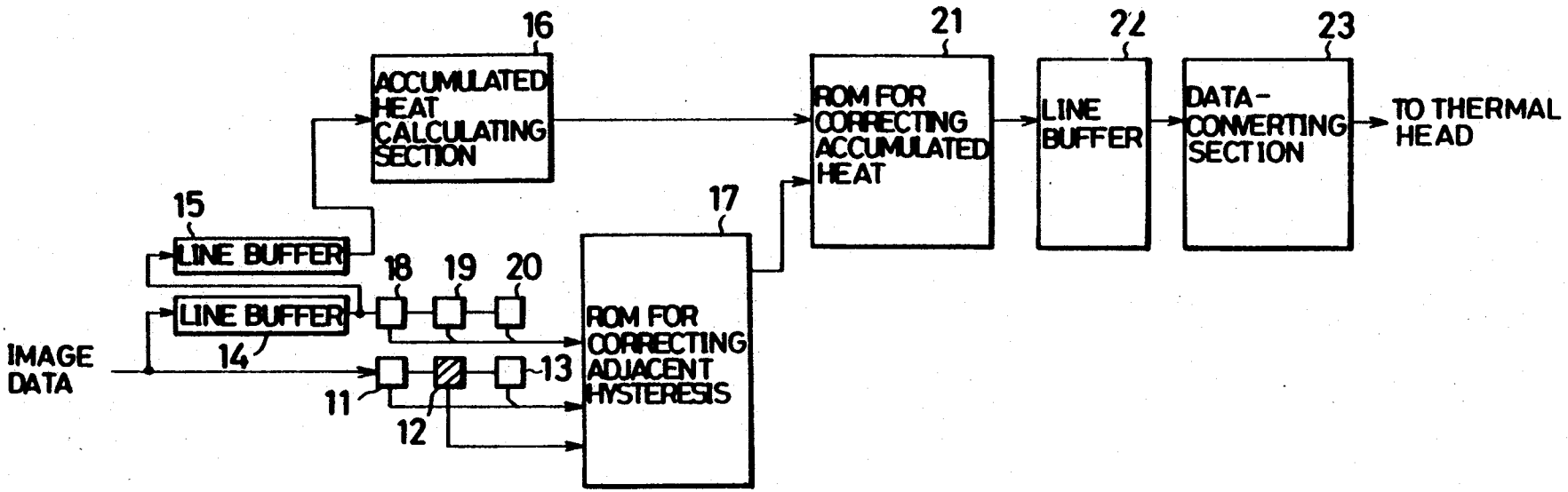
FIG. 2 is a block diagram showing a thermal head drive apparatus in one embodiment of the present invention.

FIG. 2 shows a thermal head drive apparatus in one embodiment of the present invention.

Figure 15:
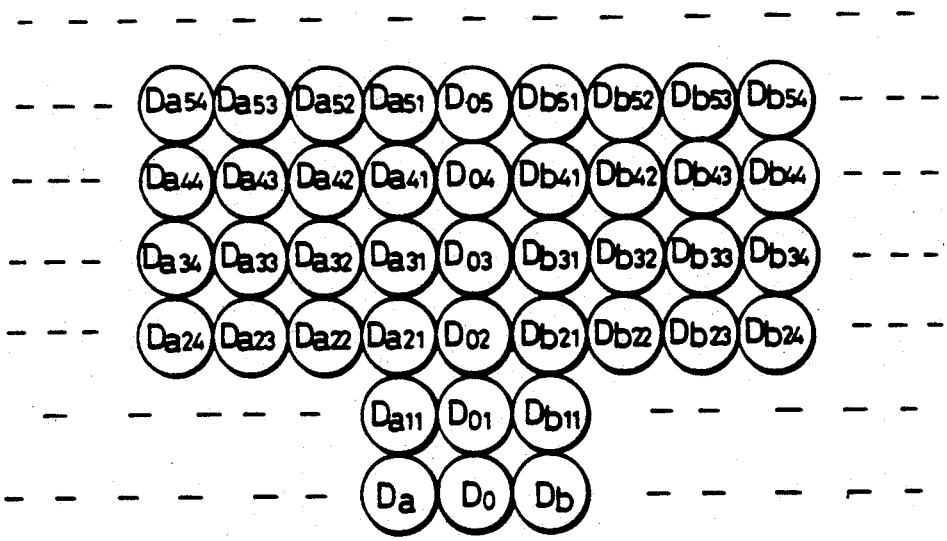
FIG. 15 is a view for explaining the embodiment shown in FIG. 2.

When image data at multiple gradations are supplied to the drive apparatus, the image data are transferred to latch circuits 11, 12 and 13 respectively having a capacity of one picture element and are delayed by one line by a line buffer 14 constituting a delay means. The image data are then transmitted to an accumulated heat calculating section 16 through a line buffer 15 constituting the delay means. Further, the respective image data from the latch circuits 11 and 12 are inputted to a read only memory (ROM) 17 for correcting an adjacent hysteresis constituting a correcting means. The image data from the line buffer 14 are inputted to the ROM 17 for correcting the adjacent hysteresis through latch circuits 18, 19 and 20 respectively having a capacity of one picture element. Accordingly, the supplied image data of one picture element are inputted to the latch circuit 11 and are simultaneously inputted to the line buffer 14. The image data located by one line before the above image data of one picture element are inputted to the latch circuit 18 from the line buffer 14. Further, the image data located approximately by two lines before the above supplied image data of one picture element are inputted to the accumulated heat calculating section 16 through the line buffer 15. When the image data of one picture element are next supplied, the above-mentioned operation is performed and simultaneously the content of the latch circuit 11 is transmitted to the latch circuit 12 and the content of the latch circuit 18 is transmitted to the latch circuit 19. When the image data of one picture element are next supplied, the above-mentioned operation is performed and simultaneously the content of the latch circuit 12 is transmitted to the latch circuit 13 and the content of the latch circuit 19 is transmitted to the latch circuit 20. When the image data of one picture element are next supplied, the above-mentioned operation is performed and simultaneously the content of the latch circuit 12 is transmitted to the ROM 17 for correcting the adjacent hysteresis and the content of the latch circuit 20 is transmitted to the ROM 17 for correcting the adjacent hysteresis. The above operations are similarly performed. As shown in FIG. 15, when the content of the latch circuit 12 is composed of image data of an object dot $D_0$, the contents of the latch circuits 11 and 13 are composed of image data of dots $D_a$ and $D_b$ before and after the object dot on the same line as that of the object dot $D_0$. The contents of the latch circuits 18, 19 and 20 are composed of image data of three dots $D_{01}$, $D_{a11}$ and $D_{b11}$ located by one line before the object dot $D_0$ and the dots $D_a$ and $D_b$ which are located before and after this object dot. The ROM 17 for correcting the adjacent hysteresis converts the image data from the latch circuit 12 to data according to the image data from the latch circuits 11, 13, 18, 19 and 20, and thereby corrects the image data of the object dot from the latch circuit 12 by the data of the respective dots $D_a$, $D_b$, $D_{01}$, $D_{a11}$ and $D_{b11}$ around the object dot $D_0$ from the latch circuits 11, 13, 18, 19 and 20. This ROM 17 thus corrects a thermal influence of the object dot $D_0$ on printed density by heating resistors before and after an object heating resistor, and corrects an influence of the object dot $D_0$ on printed density by the accumulated heat of three heating resistors located by one line before the object heating resistor and the heating resistors before and after the object heating resistor. In this correction, the data of the dots $D_a$ and $D_b$ before and after the object dot $D_0$ from the latch circuits 11, 13, 18, 19 and 20, and the data of the three dots $D_{01}$, $D_{a11}$ and $D_{b11}$ located by one line before the object dot $D_0$ and the dots $D_a$ and $D_b$ before and after this object dot are weighted in accordance with a degree of the thermal influence with respect to the object dot $D_0$ and are then added. The image data from the latch circuit 12 are corrected by the above added results and thereby the influence of the object dot $D_0$ on printed density by the above peripheral dots $D_a$, $D_b$, $D_{01}$, $D_{a11}$ and $D_{b11}$ is corrected. The accumulated heat calculating section 16 calculates an amount of accumulated heat (a heat-accumulating state) of the heating resistors from the data of the dot $D_{02}$ located by two lines before the data of the object dot $D_0$ from the line buffer 15. An accumulated heat correcting ROM 21 constituting the correcting means performs a correction of the printed density for the accumulated heat of the heating resistors by subtracting data for correction from the accumulated heat calculating section 16 from the image data from the ROM 17 for correcting the adjacent hysteresis. The image data from this accumulated heat correcting ROM 21 are transmitted to a line buffer 22 every one line amount and are sequentially converted to a pulse at each gradation level by a data-converting section 23. A thermal head has the plurality of heating resistors arranged in one line. Every time when the pulses at the respective gradation levels are transferred from the data-converting section 23, an electric current flows through the plurality of heating resistors in the thermal head in accordance with these pulses. Thus, the image is printed on a printed paper every one line in accordance with the movement thereof.

Figure 3:
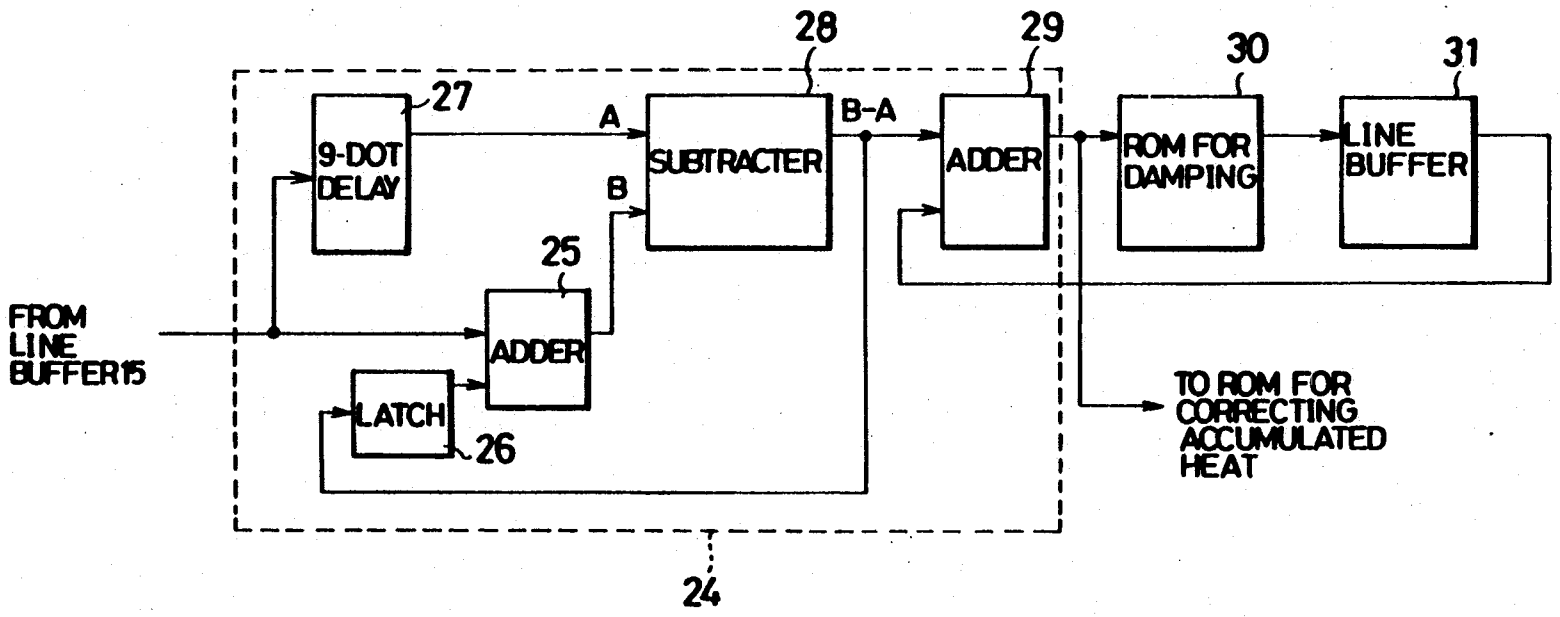
FIG. 3 is a block diagram showing an accumulated heat calculating section in the above embodiment of the present invention.

FIG. 3 shows the construction of the above accumulated heat calculating section 16.

Figure 14:
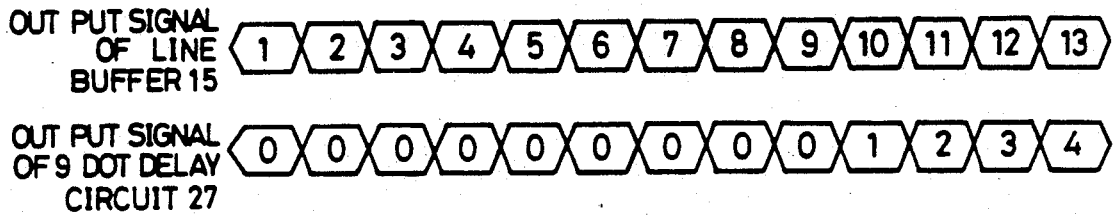
FIG. 14 is a timing chart showing the operation of the accumulated heat calculating section in FIG. 3.

In a 1-line accumulated heat calculating section 24, an adder 29 constructs a first calculating means. An adder 25, a latch circuit 26, a 9-dot delay circuit 27 and a subtracter 28 construct a second calculating means. The image data from the line buffer 15 are added to the content of the latch circuit 26 by the adder 25. The image data from the line buffer 15 are delayed by 9 dots by the 9-dot delay circuit 27 and are subtracted by the subtracter 28 from the data from the adder 25. The data from this subtracter are sequentially latched to the latch circuit 26 every one picture element. Accordingly, as shown in FIG. 14, the image data from the line buffer 15 are sequentially added by the adder 25 to the previous image data every one picture element. The image data delayed by the 9 dots from the 9-dot delay circuit 27 are subtracted by the subtracter 28 from the above added results, thereby calculating a heating amount of the heating resistors. As shown in FIG. 15, this heating amount first becomes a heating amount of nine heating resistors by the data of a dot $D_{02}$ before the object dot $D_0$ by two lines and four dots $D_{a21}$ to $D_{a24}$ and four dots $D_{b21}$ to $D_{b24}$ before and after this dot $D_{02}$. Thereafter, this heating amount becomes that sequentially considered with respect to the data of each nine dots, $D_{03}$, $D_{a31}$ to $D_{a34}$, $D_{b31}$ to $D_{b34}$; $D_{04}$, $D_{a41}$ to $D_{a44}$, $D_{b41}$ to $D_{b44}$; $D_{05}$, $D_{a51}$ to $D_{a54}$, $D_{b51}$ to $D_{b54}$; - - - on each more previous line by a closed loop composed of the adder 25, the subtracter 28 and the latch circuit 26. The data from this subtracter 28 are inputted to an adder 29. The image data from this adder 29 are damped by a ROM 30 for damping so that a thermal damping amount of the heating resistors after one line is calculated. Then, the data from this damping ROM 30 are delayed by one line by a line buffer 31 constituting the delay means. The data from this line buffer 31 are added by the adder 29 to the data from the subtracter 28 so that the amount of accumulated heat of the heating resistors is calculated. The data from this adder 29 are transmitted as data for correction to the accumulated heat correcting ROM 21. As a result, the accumulated heat correcting ROM 21 corrects the image data from the ROM 17 for correcting the adjacent hysteresis by the data for correction from the adder 29 so as to have no influence of the nine heating resistors on printed density by the accumulated heat thereof by the data of many previous dots $D_{02}$, $D_{a21}$ to $D_{a24}$, $D_{b21}$ to $D_{b24}$, $D_{03}$, $D_{a31}$ to $D_{a34}$, $D_{b31}$ to $D_{b34}$, $D_{04}$, $D_{a41}$ to $D_{a44}$, $D_{b41}$ to $D_{b44}$, - - - , as shown in FIG. 15.

Figure 4A:
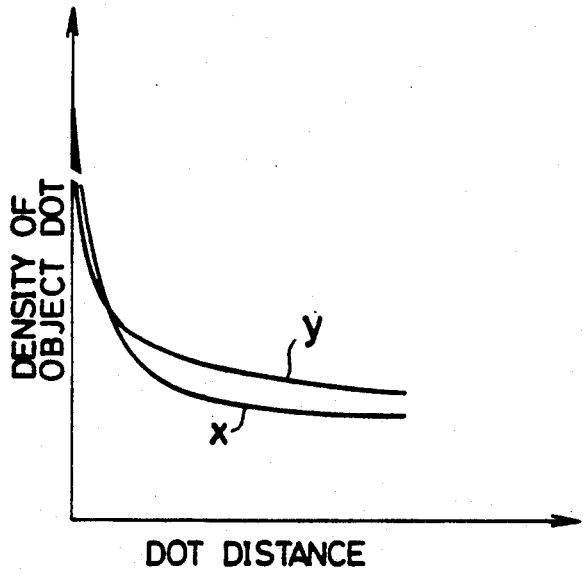
FIGS. 4*a* and 4*b* are respectively a graph and a diagram showing an influence of an object dot on density by peripheral dots.
Figure 4B:
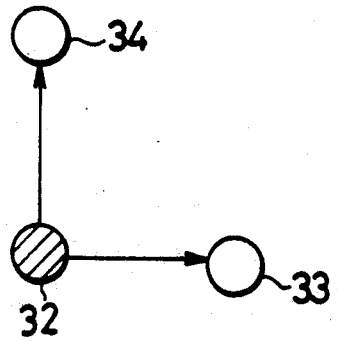

FIGS. 4*a* and 4*b* show the relation x with respect to the distance between an object dot 32 and a dot 33 located on the same line as that of the object dot and the density of the object dot 32, and the relation y with respect to the distance between the object dot and a dot 34 printed before the object dot and the density of the object dot 32.

The thermal influence by the peripheral dots around the object dot with respect to the density of the object dot 32 is extremely large as the peripheral dots approach the object dot and is small as the peripheral dots are far from the object dot. However, when the number of dots far from the object dot increases, the thermal influence of the peripheral dots around the object dot on the density of the object dot cannot be neglected. Therefore, in the above embodiment, as mentioned above, with respect to the peripheral dots near the object dot, their data are set as direct information by the ROM 17 for correcting the adjacent hysteresis. With respect to the dots except for the peripheral dots, the thermal influence of the peripheral dots around the object dot on the density of the object dot is corrected by the accumulated heat calculating section 16 with the number of dots and a sum of data levels as information.

Figure 9:
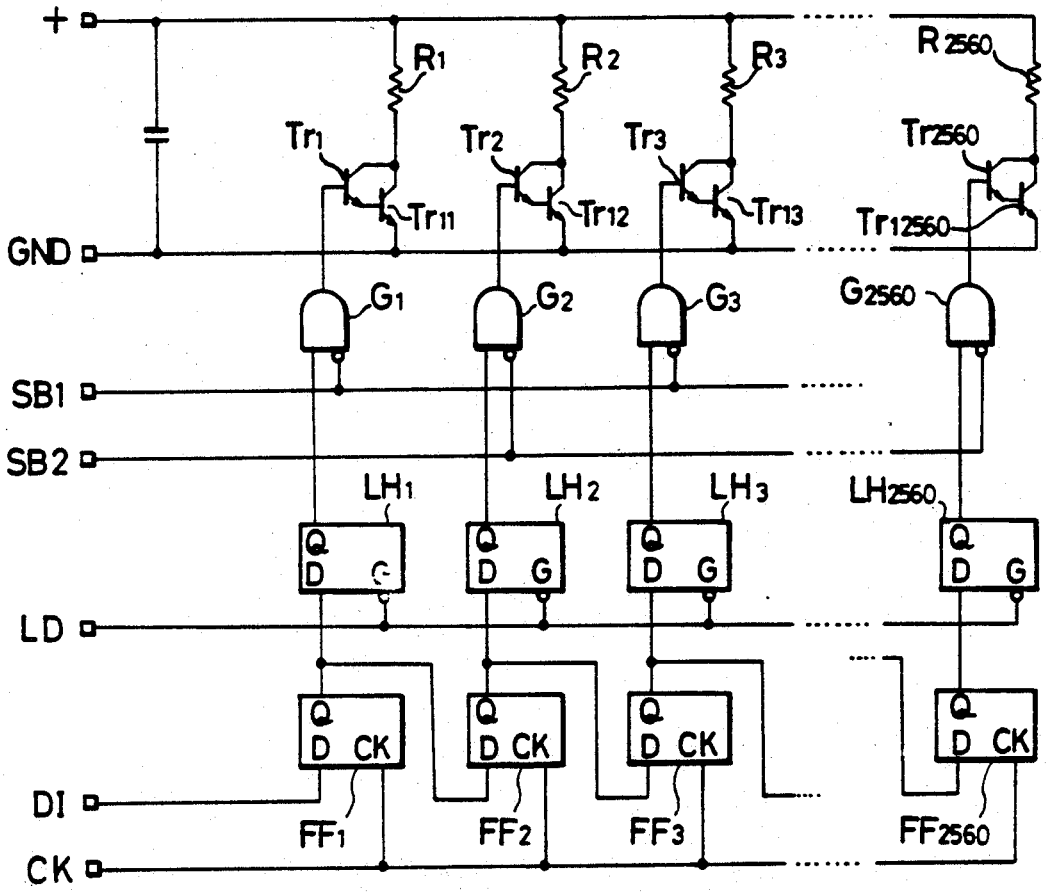
FIG. 9 is a block diagram showing the circuit construction of a thermal head in the above embodiment.
Figure 10:
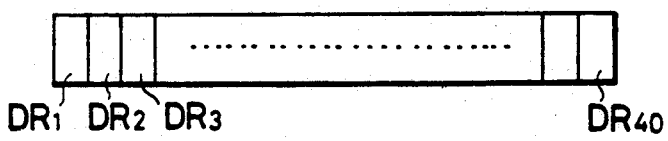
FIG. 10 is a block diagram showing a driver of the thermal head.

FIG. 9 shows the circuit construction of the above thermal head.

This thermal head has a plurality of heating resistors $R_1$ to $R_{2560}$ corresponding to the number of dots on one line. These heating resistors $R_1$ to $R_{2560}$ are arranged in one line to print an image every one line when a printed paper is intermittently stopped. A shift register composed of D-flip-flops $FF_1$ to $FF_{2560}$ inputs image data DI by a clock signal CK every one line. Latch circuits $LH_1$ to $LH_{2560}$ latch the image data on one line from the shift register by a latch signal LD. The heating resistors $R_1$ to $R_{2560}$ are divided into two groups composed of odd and even resistors. Odd gates $G_1, G_3, ---, G_{2559}$ are turned on by a first strobe pulse SB1 so that image data from the odd latch circuits $LH_1, LH_3, ---, LH_{2559}$ are supplied to the bases of odd transistors $Tr_1, Tr_3, ---, Tr_{2559}$ through the odd gates $G_1, G_3, ---, G_{2559}$. Even gates $G_2, G_4, ---, G_{2560}$ are turned on by a second strobe pulse SB2 so that image data from the even latch circuits $LH_2, LH_4, ---, LH_{2560}$ are supplied to the bases of even transistors $Tr_2, Tr_4, ---, Tr_{2560}$ through the even gates $G_2, G_4, ---, G_{2560}$. The transistors $Tr_1$ to $Tr_{2560}$ and the transistors $Tr_{11}$ to $Tr_{12560}$ are turned on in accordance with the image data from the gates $G_1$ to $G_{2560}$ so that a constant voltage is applied to the heating resistors $R_1$ to $R_{2560}$ from a direct current power source, thereby heating these heating resistors. Thus, an ink sheet is heated and the image is printed on the printed paper every one line. As shown in FIG. 9, a driver constructed by the above D-flip-flops $FF_1$ to $FF_{2560}$, the latch circuits $LH_1$ to $LH_{2560}$, the gates $G_1$ to $G_{2560}$, and the transistors $Tr_1$ to $Tr_{2560}$, $Tr_{11}$ to $Tr_{12560}$ is composed of 40 driver chips $Dr_1$ to $DR_{40}$ respectively constructed by 64 bits.

Figure 5:
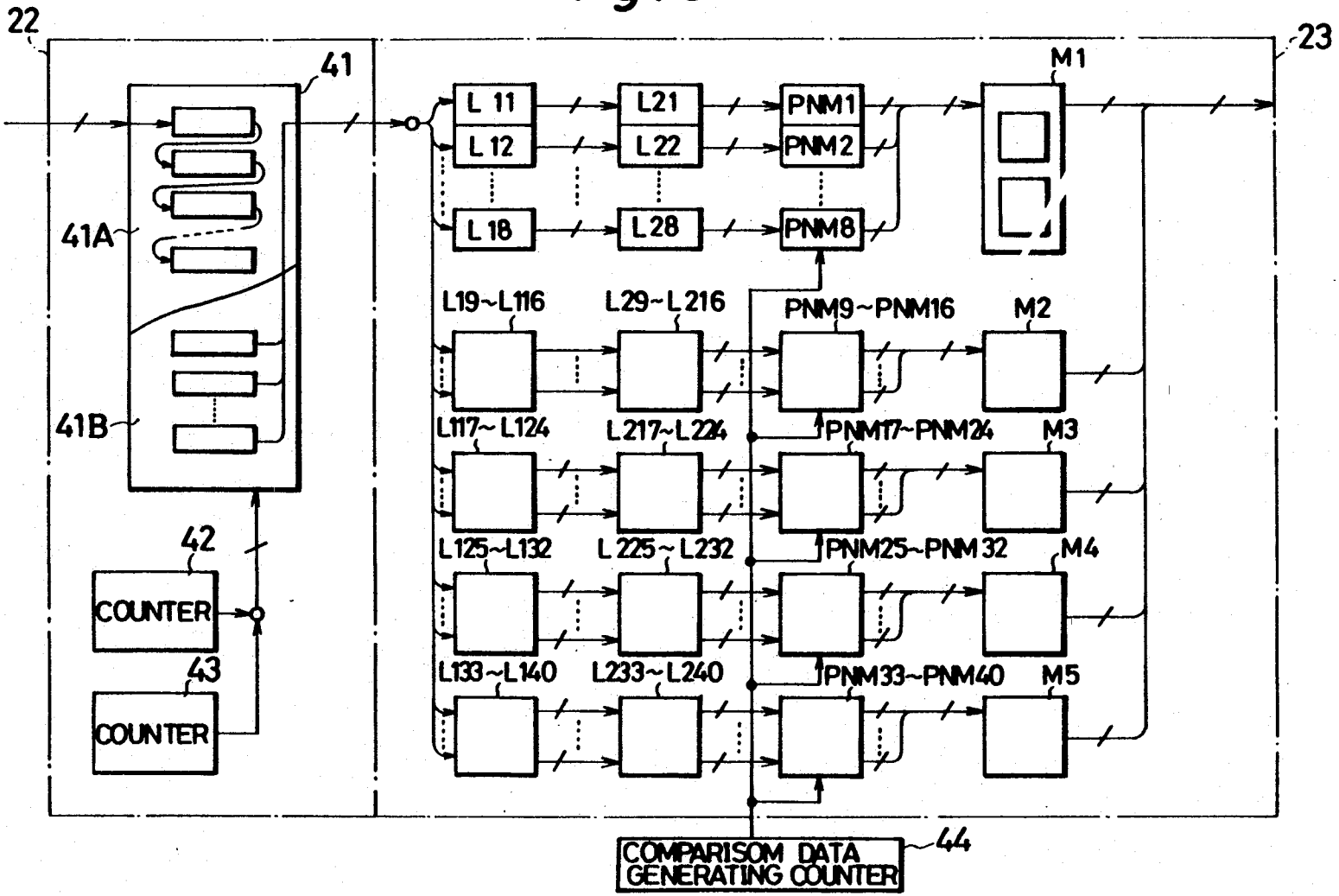
FIG. 5 is a block diagram showing a portion of the drive apparatus in the above embodiment.

FIG. 5 shows the above line buffer 22, the data-converting section 23 and a counter 44 for generating comparison data.

Figure 6:
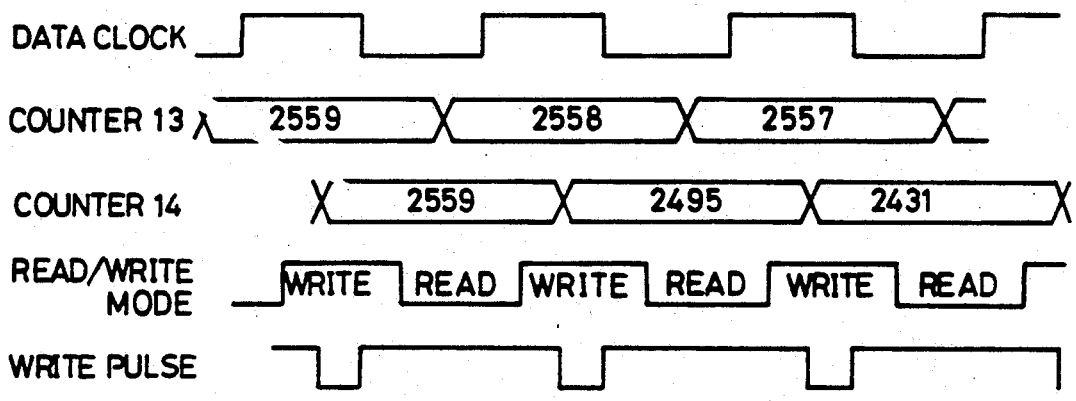
FIG. 6 is a timing chart showing the operation of the drive apparatus in the above embodiment.

A line memory 41 and counters 42, 43 are used as the line buffer 22. A line memory 41 is divided into two regions 41A and 41B every 4K byte and is switched by a line synchronization signal. The counters 42 and 43 are respectively composed of counters for performing writing and reading operations and have an initial value 2559. A counting-down operation is performed with respect to the respective counters every writing and reading operations of the image data of the memory 41. After the counted values of the counters 42 and 43 become zero, no incremental data are written to the memory 41. Output values of the counters 42 and 43 are switched by a Read/Write mode signal and are alternately outputted. As shown in FIG. 6, the image data are written to memory addresses one by one in the memory 41 in a reducing direction such as 2559, 2558, ---, 0. The image data are read out of the memory 41 every 64 memory addresses such as 2559, 2495, ---, 63, 2558, 2494, ---, 62, ---, 0. This is because the drivers $DR_1$ to $DR_{40}$ of the thermal head are constructed by 64 bits.

The data-converting section 23 is constructed by latch circuits L11 to L140 at a first stage, latch circuits L21 to L240 at a second stage, Pulse Number Module circuits PNM1 to PNM40 composed of a magnitude comparator, and head memories M1 to M5. The operation of the data-converting section 23 is as follows.

(1) First, 40 image data are sequentially read out of the addresses 2559, 2495, ---, 63 of the line memory 41 and are latched to the latch circuits L11 to L140 at the first stage. When the 40 image data have been completely latched, the contents of the latch circuits L11 to L140 at the first stage are simultaneously latched to the latch circuits L21 to L240 at the second stage.

(2) The data of the latch circuits L21 to L240 at the second stage are compared with value "0" of comparison data from the counter 44 for generating the comparison data by the PNM circuits PNM1 to PNM40 at the next stage. When the data of the latch circuits L21 to L240 are greater than the value "0" of the comparison data, these data are set to "1". When the data of the latch circuits L21 to L240 are equal to or smaller than the value "0" of the comparison data, these data are set to "0". Thus, the data of the latch circuits L21 to L240 are two-valued and written to the head memories M1 to M5 at the next stage.

(3) Next, the data of the latch circuits L21 to L240 at the second stage are compared with value "1" of the comparison data from the comparison data generating counter 44 by the PNM circuits PNM1 to PNM40 at the next stage. When the data of the latch circuits L21 to L240 are greater than the value "1" of the comparison data, these data are set to "1". When the data of the latch circuits L21 to L240 are equal to or smaller than the value "1" of the comparison data, these data are set to "0". Thus, the data of the latch circuits L21 to L240 are two-valued and written to the head memories M1 to M5 at the next stage.

(4) Next, the data of the latch circuits L21 to L240 at the second stage are compared with value "2" of the comparison data from the comparison data generating counter 44 by the PNM circuits PNM1 to PNM40 at the next stage. When the data of the latch circuits L21 to L240 are greater than the value "2" of the comparison data, these data are set to "1". When the data of the latch circuits L21 to L240 are equal to or smaller than the value "2" of the comparison data, these data are set to "0". Thus, the data of the latch circuits L21 to L240 are two-valued and written to the head memories M1 to M5 at the next stage. The comparison data from the comparison data generating counter 44 indicate a sequentially increased threshold level. Similarly, the data of the latch circuits L21 to L240 at the second stage are sequentially compared with values "3", "4", "5", ---, "255" of the respective comparison data from the comparison data generating counter 44 by the PNM circuits PNM1 to PNM40 at the stage. Thus, the data of the latch circuits L21 to L240 are two-valued and the respective binary data are written to the head memories M1 to M5. By such an operation, the data of the latch circuits L21 to L240 at the second stage are converted to data at 256 gradations and are written to the head memories M1 to M5.

The addresses of the head memories M1 to M5 show a dot number with respect to upper 6 bits and show a level number (number at gradation level with respect to lower 8 bits. In the above items (1) to (4), with respect to the addresses of the head memories M1 to M5, the dot number is "0" and the level number is "0" to "255" in accordance with the comparison data (gradation level) of the comparison data generating counter 44.

In the operations of the above items (2) to (4), the next 40 image data are read out of the addresses 2558, 2494, - - - , 62 of the line memory 41 and are latched to the latch circuits L11 to L140 at the first stage and these image data are in a standby state.

After the operations of the above items (2) to (4) have been completed, the contents of the latch circuits L11 to L140 at the first stage are simultaneously latched to the latch circuits L21 to L240 at the second stage and the dot number is set to "1". Then, the operations of the above items (2) to (4) are performed so that the data of the latch circuits L21 to L240 at the second stage are converted to data at 256 gradations and are written to the head memories M1 to M5.

Similarly, the image data are read out of the line memory 41 every 40 data and are converted to data at 256 gradations and are written to the head memories M1 to M5. In this case, the dot number is switched from "2" to "63" in accordance with the reading operation of the image data every 40 data.

Figure 8:
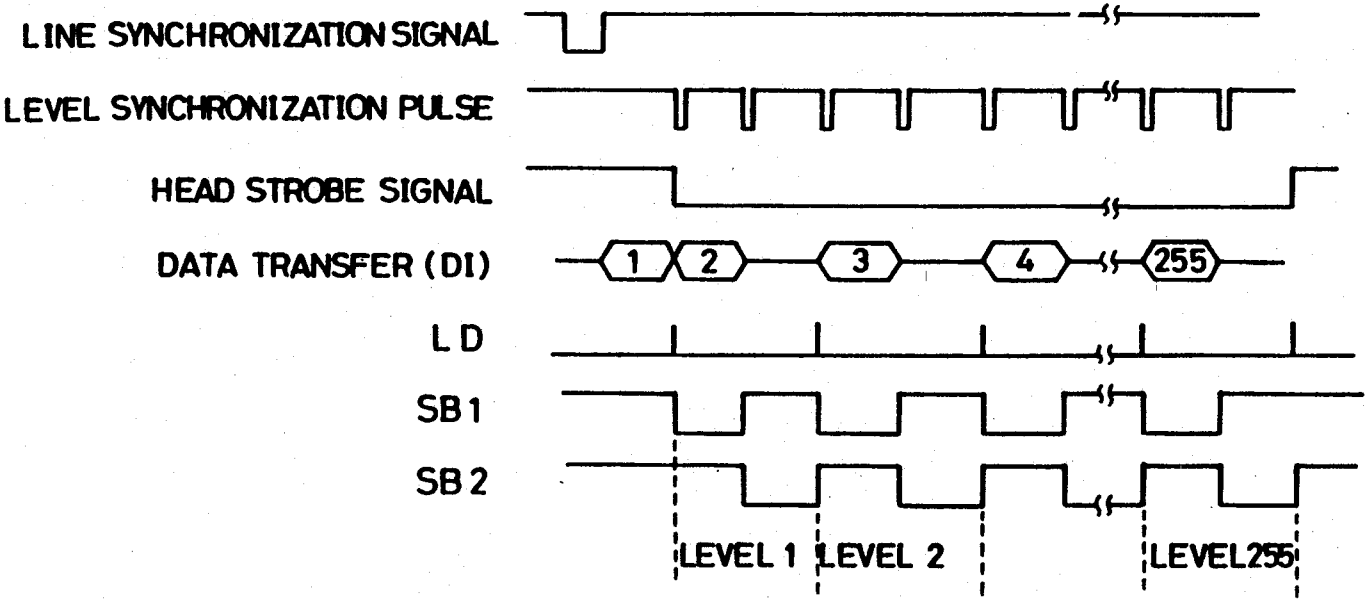
FIG. 8 is a timing chart showing the operation of the drive apparatus in the above embodiment.

Next, the data are read out of the head memories M1 to M5 with the level number "0" and the dot numbers "0" to "63" in synchronization with a head latch signal LD. These data are transmitted as image data DI to the thermal head. Next, the data are read with the level number "1" and the dot numbers "0" to "63" and are transmitted as the image data DI to the thermal head. Similarly, the data are read with each of the level numbers "2" to "255" and the dot numbers "0" to "63" and are transmitted as the image data DI to the thermal head. FIG. 8 shows a timing of the above operation.

Similar to the line memory 12, the head memories M1 to M5 are respectively divided into two regions of 64×256 byte and these two regions are switched by a line synchronization signal.

Figure 7:
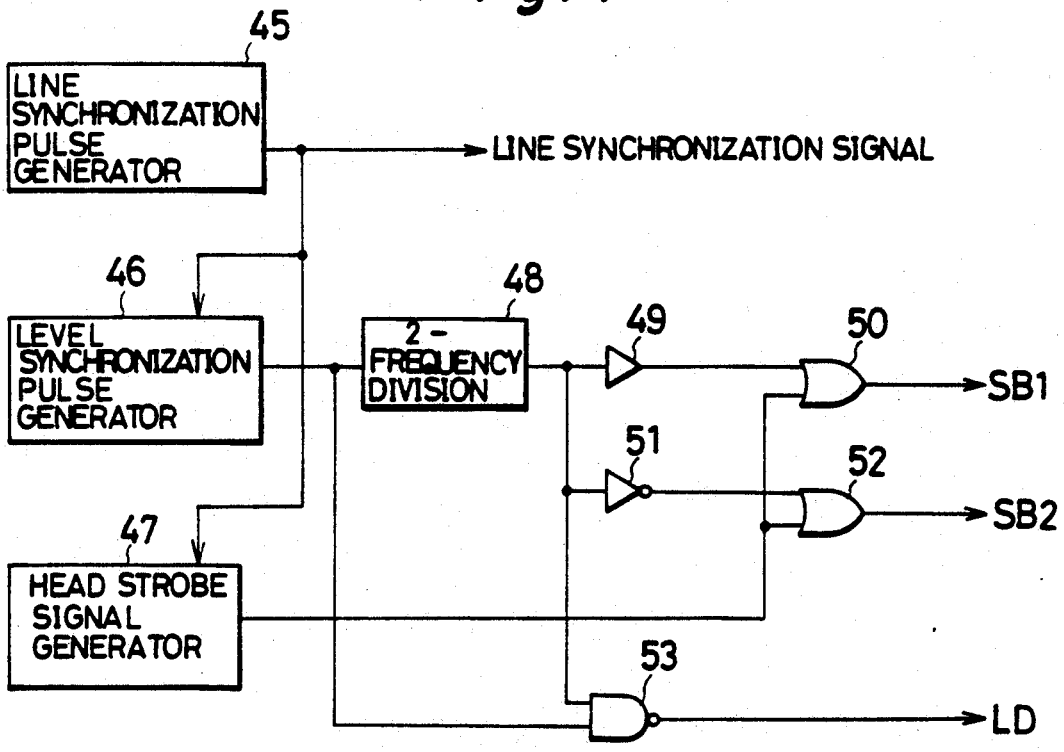
FIG. 7 is a block diagram showing a pulse width timer in the above embodiment.

FIG. 7 shows a pulse width timer in this embodiment.

A generator 45 for generating a line synchronization pulse generates a line synchronization signal. A level synchronization pulse generator 46 generates a level synchronization pulse having as a period a time for applying the pulse to each block of the heating resistors $R_1$ to $R_{2560}$ in the thermal head. A head strobe signal generator 47 generates a pulse applying enable signal at each of the gradation levels "1" to "255". The level synchronization pulse generator 46 and the head strobe signal generator 47 are reset by the line synchronization signal from the line synchronization pulse generator 45. An output signal of the level synchronization pulse generator 46 is divided into two sections by a two-frequency dividing circuit 48. An OR operation is performed by an OR circuit 50 with respect to the divided signal transmitted through a buffer 49 and an output signal of the head strobe signal generator 47. The output signal of the two-frequency dividing circuit 48 is inverted by an inverter 51. An OR operation is performed by an OR circuit 52 with respect to the inverted signal and the output signal of the head strobe signal generator 47. Output signals of these OR circuits 50 and 52 are transmitted to the thermal head as a strobe pulse SB1 for selecting the first group of heating resistors $R_1$, $R_3$, - - - , $R_{2559}$ and a strobe pulse SB2 for selecting the second group of heating resistors $R_2$, $R_4$, - - - , $R_{2560}$. A NAND circuit 53 performs a NAND operation with respect to the output signal of the level synchronization pulse generator 46 and the output signal of the two-frequency dividing circuit 48. An output signal of this NAND circuit 53 is transmitted to the thermal head as a head latch signal LD.

Figure 11:
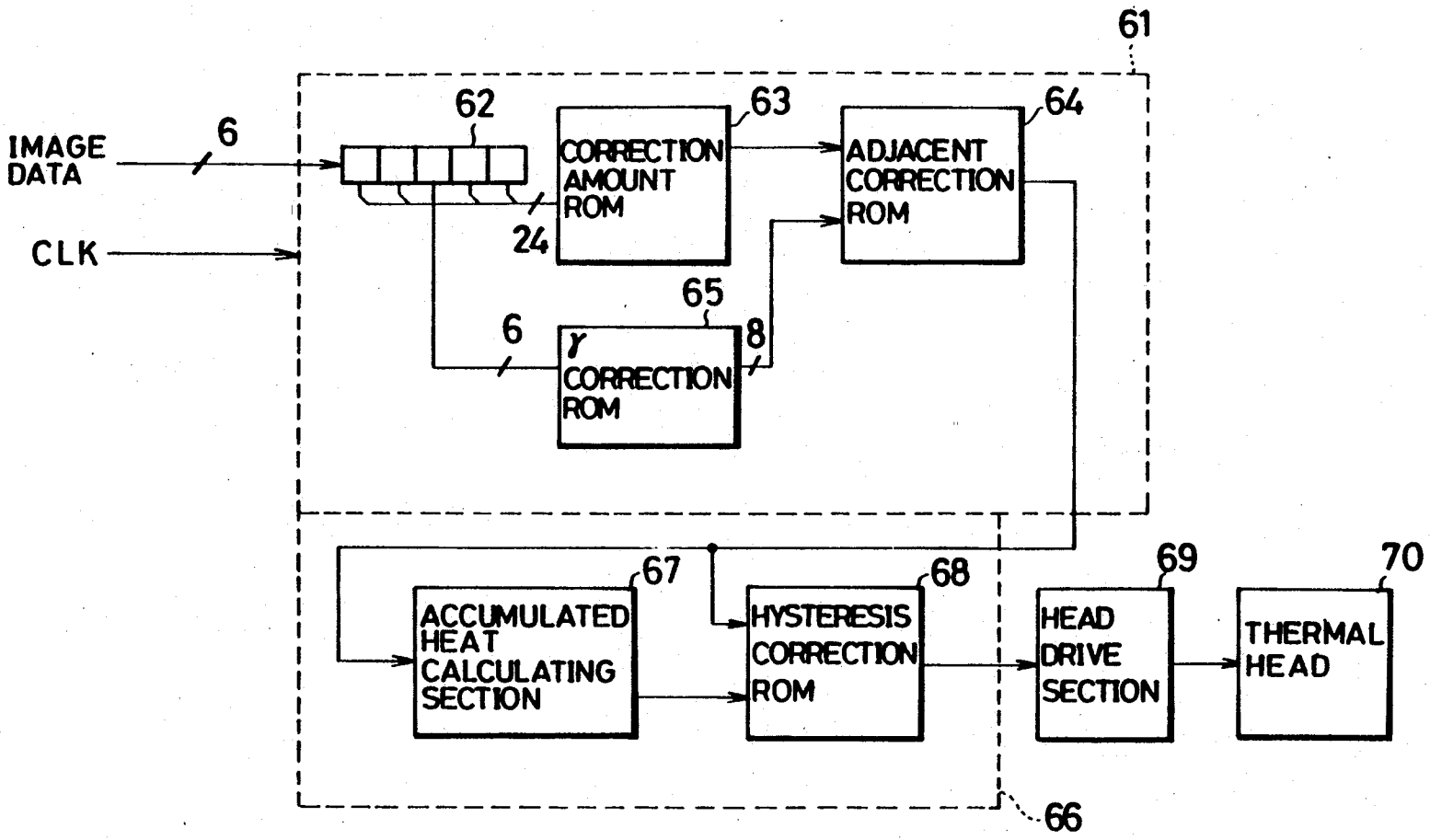
FIG. 11 is a block diagram showing the thermal head drive apparatus in another embodiment of the present invention.

FIG. 11 shows the thermal head drive apparatus in another embodiment of the present invention.

An adjacent correcting section 61 is constructed by a shift register 62, a correction amount ROM 63, an adjacent correction ROM 64 and a $\gamma$ correction ROM 65. A hysteresis correcting section 66 is constructed by an accumulated heat calculating section 67 and a hysteresis correction ROM 68.

Image data at multiple gradations are inputted to the adjacent correcting section 61 from the exterior of the apparatus in synchronization with a synchronization clock signal CLK and are latched at a first stage of he shift register 62. When the next image data at multiple gradations are inputted, the image data latched at the first stage of the shift register 62 are shifted to a second stage thereof and the above image data from the exterior of the apparatus are latched at the first stage of the shift register. Similarly, every time when the image data at multiple gradations are inputted from the exterior of the apparatus, these image data are latched at the first stage of the shift register 62 and the previous image data latched at the first stage of the shift register 62 are shifted to the second stage thereof. The previous image data latched at the second stage of the shift register 62 are shifted to a third stage thereof. The previous image data latched at the third stage of the shift register 62 are shifted to a fourth stage thereof. The previous image data attached at the fourth stage of the shift register 62 are shifted to a fifth stage thereof.

The image data X latched at the third stage of the shift register 62 are converted to pulse number data P showing a density level as a pulse number by the $\gamma$ correction ROM 65.

The image data latched at the first, second, fourth and fifth stages of the shift register 62 are four image data composed of two image data before the image data X latched at the third stage of the shift register 62 and two image data after these image data X. These four image data are converted by the correction amount ROM 63 constituting a calculating means to data H indicative of a thermal influence amount by four heating resistors composed of two heating resistors before the object heating resistor and two heating resistors after the object heating resistor.

The pulse number data P from the $\gamma$ correction ROM 65 are corrected by the amount of the thermal influence amount data H from the correction amount ROM 63 by using the adjacent correction ROM 64 constituting the correcting means. The corrected data are then converted to suitable pulse number data R so as to have no thermal influence by the four heating resistors composed of two heating resistors before the object heating resistor and two heating resistors after the object heating resistor.

The accumulated heat calculating section 67 calculates data of the amount of accumulated heat of the object heating resistor and the heating resistors before and after the object heating resistor as data for correction from the pulse number data R from the adjacent correction ROM 64. The suitable pulse number data with respect to the amount of accumulated heat of the object heating resistor and the heating resistors before and after the object heating resistor are written in advance as a table to the hysteresis correction ROM 68 constituting the correcting means. The pulse number data R from the adjacent correction ROM 64 are corrected and converted by the hysteresis correction ROM 68 to suitable pulse number data by using the data for correction from the accumulated heat calculating section 67 so as to have no thermal influence with respect to the object heating resistor by the amount of accumulated heat of the object heating resistor and the heating resistors before and after the object heating resistor.

A head drive section 69 is constructed by the above line buffer 22 and and the data-converting section 23. A thermal head 70 is similarly constituted by that described in the above embodiment. The head drive section 69 drives the thermal head 70 by the pulse number data from the hysteresis correction ROM 68 and an image is printed on a printed paper every one line by the movement thereof.

Figure 12:
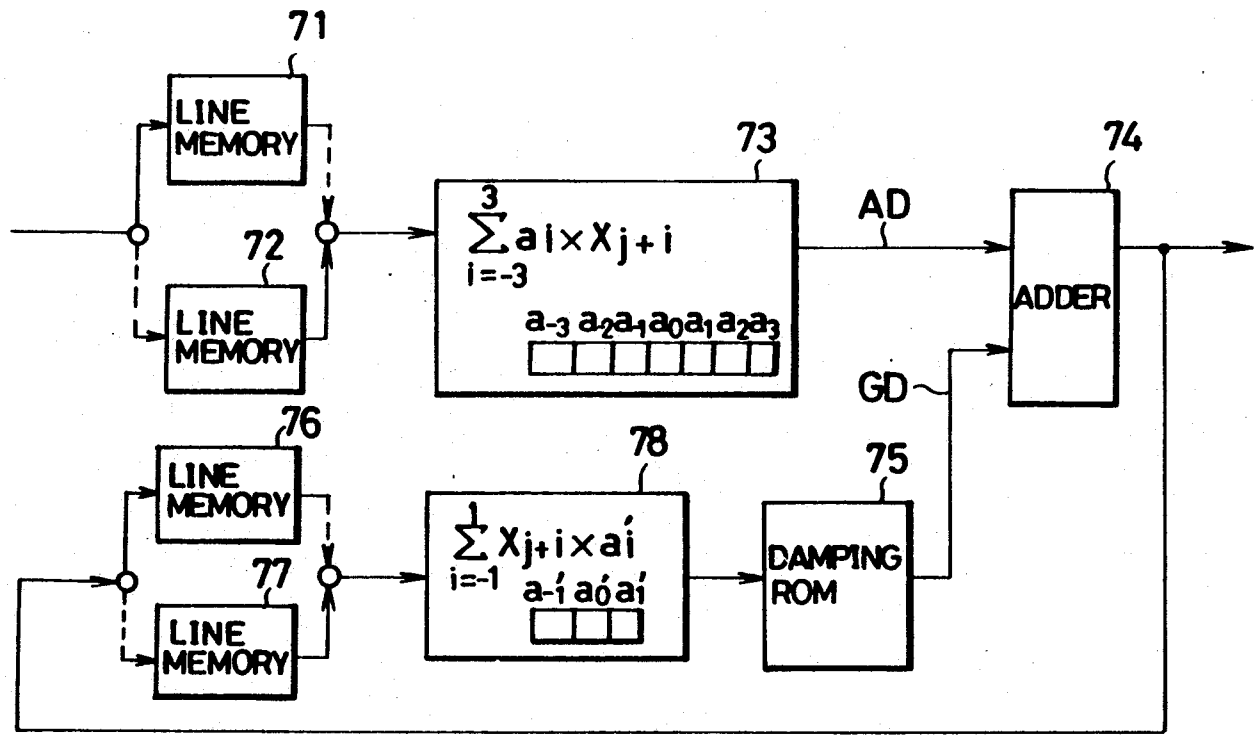
FIG. 12 is a block diagram showing the construction of an accumulated heat calculating section in the another embodiment.

FIG. 12 shows the construction of the above accumulated heat calculating section 67.

The pulse number data R from the adjacent correction ROM 64 are alternately written to line memories 71 and 72 constituting a delay means every one line. The line memories 71 and 72 perform a toggle operation every one line so hat writing and reading operations are switched with respect to each other. Namely, when one of the line memories 71 and 72 performs the writing operation, the other performs the reading operation. In the reading operation, the line memories 71 and 72 read the pulse number data Xj of an object picture element located before by one line and the pulse number data Xj−3 to Xj−1, Xj+1 to Xj+3 every three picture elements before and after the object picture element. These pulse number data are respectively multiplied by weighted coefficients a−3 to a3 by a calculating section 73 and an additional operation is performed with respect to these weighted data. Here, reference numeral a0 is a weighted coefficient with respect to the pulse number data of the object picture element located before by one line. Reference numerals a−3 to a−1 are weighted coefficients with respect to he pulse number data of the picture elements located by three to one picture element before he object picture element located before by one line. Reference numerals a1 to a3 are weighted coefficients with respect to the pulse number data of the picture elements located by one to three picture elements after the object picture element located before by one line. The above weighted coefficients satisfy the following formula.

$$\sum_{i=-3}^{3} ai = 1$$

Data AD from the calculating section 73 are provided by the following formula.

$$AD = \sum_{i=-3}^{3} ai \times Xj + i$$

These data AD become data of the amount of accumulated heat by the pulse number data located before by one line with respect to the object heating resistor and six heating resistors composed of three heating resistors before the object heating resistor and three heating resistors after the object heating resistor. These data AD are added to data GD from a damping ROM 75 by an adder 74 constituting a calculating means and are alternately written to line memories 76 and 77 constituting a delay means every one line. The line memories 76 and 77 perform a toggle operation every one line so that writing and reading operations are switched with respect to each other. Namely, when one of the line memories 76 and 77 performs the writing operation, the other performs the reading operation. In the reading operation, the line memories 76 and 77 rad calculation data Xj+i' located before by one line and calculation data Xj+i'−1, Xj+i'+1 located before and after the calculation data Xj+i' by one. These calculation data are respectively multiplied by weighted coefficients a−1' to a1' by a calculating section 78 and an additional operation is performed with respect to these weighted data. Here, reference numeral a0' is a weighted coefficient with respect to the calculation data located before by one line. Reference numerals a−1' to a1' are weighted coefficients with respect to the calculation data located by one before and after the calculation data located before by one line. The above weighted coefficients satisfy the following formula.

$$\sum_{i=-1}^{1} ai' = 1$$

Data from the calculating section 78 are provided by the following formula.

$$\sum_{i=-1}^{1} ai' \times Xj + i'$$

These data are damped by a predetermined amount by the damping ROM 75 and are inputted to the adder 74. The data AD from the calculating section 73 are data of the amount of accumulated heat by the pulse number data located before by one line with respect to the object heating resistor, three heating resistors before the object heating resistor and three heating resistors after the object heating resistor. These data AD are inputted to the damping ROM 75 through the adder 74, the line buffer 76 or 77 and the calculating section 78, thereby obtaining data of the amount of accumulated heat from the damping ROM 75 by the pulse number data located before by two lines with respect to the object heating resistor, four heating resistors before the object heating resistor and four heating resistors after the object heating resistor. These data are inputted to the damping ROM 75 through the adder 74, the line buffer 76 or 77 and the calculating section 78 so that the data from the damping ROM 75 become data of the amount of accumulated heat by the pulse number data located before by three lines with respect to the object heating resistor, five heating resistors before the object heating resistor and five heating resistors after the object heating resistor. Similarly, the data from the damping ROM 75 are circulated through the adder 74, the line buffer 76 or 77, the calculating section 78 and the damping ROM 75, thereby obtaining data of the amount of accumulated heat by the previous pulse number data with respect to the respective heating resistors. As a result, the data from the adder 74 are inputted to the hysteresis correction ROM 68 as data for correction, and the pulse number data R from the adjacent correction ROM 64 are corrected by the amount of accumulated heat by the previous pulse number data with respect to the respective heating resistors. Thus, the object heating resistor is constructed to print the picture elements without any influence on the accumulated heat of the object heating resistor and the other heating resistors. In this case, the object heating resistor has no influence on the accumulated heat of the other heating resistors. However, two groups of the other two heating resistors are increased every time when the resistors are located before by one line. Thus, the accumulated heat of the other heating resistors endlessly includes the previous accumulated heat.

In accordance with this embodiment, the thermal influence amount easily calculated by the heating resistors before and after the object heating resistor is calculated by the ROMs in the adjacent correcting section 61. The amounts of accumulated heat of the object heating resistor and the other heating resistors, which are not easily calculated, are calculated by the accumulated heat calculating section 67. Therefore, the construction of the apparatus is simplified and it is possible to calculate the amount of accumulated heat in a wide range.

Figure 13:
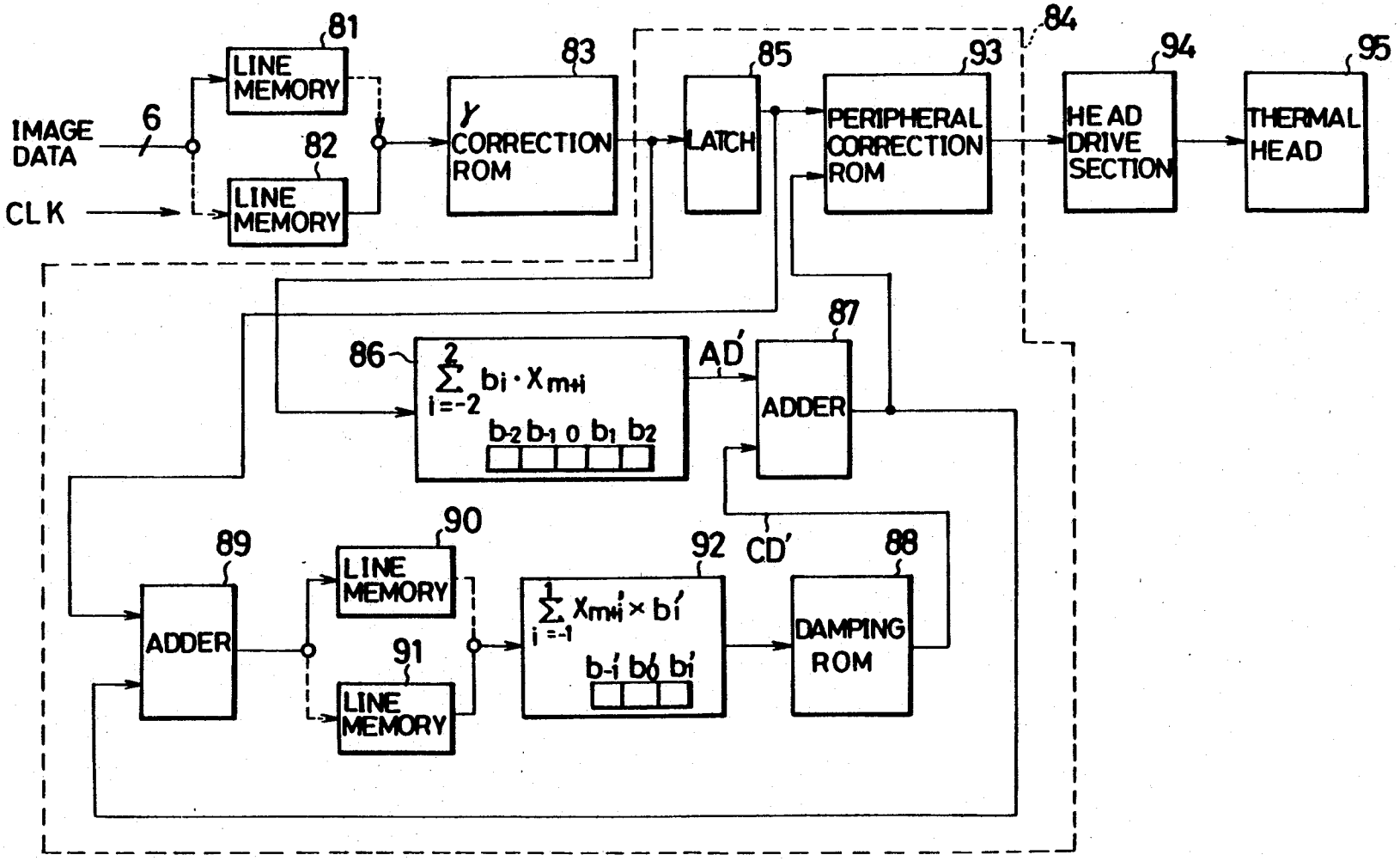
FIG. 13 is a block diagram showing the thermal head drive apparatus in another embodiment of the present invention.

FIG. 13 shows the thermal head drive apparatus in another embodiment of the present invention.

Image data at multiple gradations are inputted to the apparatus in synchronization with a synchronization clock signal CLK and are alternately written to line memories 81 and 82 every one line. The line memories 81 and 82 perform a toggle operation every one line so that writing and reading operations are switched with respect to each other. Namely, when one of the line memories 81 and 82 performs the writing operation, the other performs the reading operation. In the reading operation, the line memories 81 and 82 read the image data of an object picture element and the image data of two picture elements adjacent to the object picture element before the object picture element and two picture elements adjacent to the object picture element after the object picture element. These image data are converted by a $\gamma$ correction ROM 83 to pulse number data showing a density level as a pulse number.

The pulse number data from the $\gamma$ correction ROM 83 are inputted to a peripheral correcting section 84 and only the pulse number data of the object picture element are latched to a latch circuit 85. The pulse number data of the two picture elements adjacent to the object picture element before the object picture element and the two picture elements adjacent to the object picture element after the object picture element are multiplied by weighted coefficients b−2 to b2 by using a calculating section 86 and an additional operation is performed with respect to the weighted data. Here, reference numerals b−2 and b−1 are weighted coefficients with respect to the pulse number data Xm−2 and Xm−1 of the picture elements respectively located before the object picture element by two elements and one element. Reference numerals b1 and b2 are weighted coefficients with respect to the pulse number data Xm+1 and Xm+2 of the picture elements respectively located after the object picture element by one element and two elements. Data AD′ from the calculating section 86 are provided by the following formula when b0=0.

$$AD' = \sum_{i=-3}^{3} bi \times Xm + i$$

These data AD′ become data of the amount of accumulated heat by the pulse number data with respect to the object heating resistor and three heating resistors before the object heating resistor and three heating resistors after the object heating resistor. These date AD′ are added by an adder 87 to data GD′ from a damping ROM 88. The added data are further added by an adder 89 constituting a calculating means to the pulse number data Xm of the object picture element from the latch circuit 85 and are alternately written to line memories 90 and 91 constituting a delay means every one line. The line memories 90 and 91 perform a toggle operation every one line so that writing and reading operations are switched with respect to each other. Namely, when one of the line memories 90 and 91 performs the writing operation, the other performs the reading operation. In the reading operation, the line memories 90 and 91 read calculation data Xm+i′ located before by one line and calculation data Xm+i′−1, Xm+i′+1 located before and after the calculation data Xm+i′ by one. These calculation data are respectively multiplied by weighted coefficients b−1′ to b1′ by a calculating section 92 and an additional operation is performed with respect to these weighted data. Here, reference numeral b0′ is a weighted coefficient with respect to the calculation data located before by one line. Reference numerals b−1′ to b1′ are weighted coefficients with respect to the calculation data located by one before and after the calculation data located before by one line. The above weighted coefficients satisfy the following formula.

$$\sum_{i=-1}^{1} bi' = 1$$

Data from the calculating section 92 are provided by the following formula.

$$\sum_{i=-1}^{1} bi' \times Xm + i'$$

These data are multiplied by a damping coefficient r ($0<r<1$) by the damping ROM 88 and are inputted to the adder 87. The data AD′ from the calculating section 86 are data of the amount of accumulated heat by the pulse number data with respect to the object heating resistor, three heating resistors before the object heating resistor and three heating resistors after the object heating resistor. These data AD′ are added to the pulse number data from the latch circuit 85 by the adder 89 through the adder 87 and are inputted to the damping ROM 88 through the line buffer 90 or 91 and the calculating section 92. The data of the amount of accumulated heat by the pulse number data located before by one line with respect to the object heating resistor, four heating resistors located before the object heating resistor and four heating resistors located after the object heating resistor are thus obtained from the damping ROM 88. Further, these data are added to the pulse number data from the latch circuit 85 by the adder 89 through the adder 87 and are inputted to the damping ROM 88 through the line buffer 90 or 91 and the calculating section 92. Thus, the data from the damping ROM 88 become data of the amount of accumulated heat by the pulse number data located before by two lines with respect to the object heating resistor, five heating resistors before the object heating resistor and five heating resistors after the object heating resistor. Similarly, the data from the damping ROM 88 are added to the pulse number data from the latch circuit 85 by the adder 89 through the adder 87 and are inputted to the damping ROM 88 through the line buffer 90 or 91 and the calculating section 92. Such an operation is performed repeatedly so that the data of the amount of accumulated heat by the previous pulse number data with respect to the respective heating resistors are obtained as data for correction.

The pulse number data of the object picture element from the latch circuit 85 are corrected by a peripheral correction ROM 93 constituting a correcting means by using the data for correction from the adder 87 so as to have no thermal influence by two heating resistors adjacent to the object heating resistor before the object heating resistor and two heating resistors adjacent to the object heating resistor after the object heating resistor. Further, the pulse number data of the object picture element from the latch circuit 85 are corrected by the peripheral correction ROM 93 by using the data for correction from the adder 87 so as to have no thermal influence by the amounts of accumulated heat of the object heating resistor and the heating resistors before and after the object heating resistor. In this case, the object heating resistor is not influenced by the accumulated heat of the other heating resistors. However, two groups of the other two heating resistors are increased every time when the resistors are located before by one line. Thus, the accumulated heat of the other heating resistors endlessly includes the previous accumulated heat. The constructions of a head drive section 94 and a thermal head 95 are similar to those described in the above-mentioned embodiment. Namely, the head drive section 94 drives the thermal head 95 by the pulse number data from the peripheral correction ROM 93 so that an image is printed on a printed paper every one line by the movement thereof.

In accordance with this embodiment, the data of the picture elements around the object picture element are treated by the peripheral correcting section 84 as peripheral data without dividing the data into the data of the picture elements before and after the object picture element and the data of the picture elements located before the object picture element by more than one line. Accordingly, the construction of the apparatus is simplified and it is possible to reliably correct the data of the object picture element by the peripheral data in a wide range.

In the first embodiment, the damping ROM 30 may be disposed after the line buffer 31. In the second embodiment, the calculating section 78 and the damping ROM 75 may be inserted before the line memories 76 and 77. Similarly, in the third embodiment, the calculating section 92 and the damping ROM 88 may be inserted before the line memories 91 and 92.

As mentioned above, in the thermal head drive apparatus for printing an image at multiple gradations in the present invention, it is possible to correct an influence of the object picture element on density by the heat-accumulating state of the heating resistors using the simplified construction and the data of many dots.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for driving a plurality of heating resistors arranged in one line in a thermal head by using image data to perform a printing operation with respect to picture elements every one line, said apparatus comprising:

first correcting means (17) for initially correcting image data to be printed by one heating resistor according to adjacent image data printed in the same printing operation so as to cancel a thermal influence of adjacent heating resistors on said one heating resistor;

first delay means (15) for delaying image data to provide previous image data;

a calculating section (16) coupled to said first delay means for outputting correction data representing an amount of accumulated heat of heating resistors by previous printing operations according to previous image data, said calculating section including second delay means (31) for delaying said correction data, damping means (30) for damping delayed correction data so as to represent accumulated heat after one line printing period, calculating means (29) for calculating said correction data by using damped correction data;

second correcting means (21) for correcting initially corrected image data according to said correction data so as to cancel an influence of said accumulated heat of heating resistors on said one heating resistor; and driving means for driving said one heating resistor according to image data corrected by said second correcting means.

2. An apparatus according to claim 1, wherein said first correcting means includes means for correcting said image data so as to cancel thermal influence of a previous printing operation by one line.

3. An apparatus according to claim 1, wherein said delay means includes means (14, 15) for delaying image data by two printing lines.

4. An apparatus according to claim 1, wherein said calculating section further includes another calculating means for calculating a heating amount of heating resistors according to said previous image data.

5. An apparatus according to claim 4, wherein said calculating means comprises an adder for adding said delayed correction data to an output of said another calculating means.

6. An apparatus according to claim 1, wherein said first correcting means includes memory means for storing a plurality of initially corrected image data as sets of image data and adjacent image data.

7. An apparatus according to claim 1, wherein said second correcting means includes memory means for storing image data corrected by said second correcting means as initially corrected data and correction data.

8. An apparatus for driving a plurality of heating resistors arranged in one line in a thermal head by using image data to perform a printing operation with respect to picture elements every one line, said apparatus comprising:

first correcting means (61) for initially correcting image data to be printed by one heating resistor according to adjacent image data printed in the same printing operation so as to cancel a thermal influence of adjacent heating resistors on said one heating resistor;

a calculating section (67) coupled to said first correcting means for outputting correction data representing an amount of accumulated heat of heating resistors by previous printing operations according to initially corrected image data, said calculating section including first delay means (71) for delaying said initially corrected image data, calculating means (73) for calculating a heating amount of heating resistors, second delay means (76) for delaying said correction data, damping means (75) for damping delayed correction data so as to represent accumulated heat after one line printing period, and another calculating means (74) for calculating an amount of accumulated heat of said heating resistors according to damped correction data and said heating amount;

second correcting means (68) for correcting said initially corrected image data according to said correction data so as to cancel an influence of said accumulated heat; and head driving means (69) for driving said one heating resistor according to image data corrected by said second correcting means.

9. An apparatus according to claim 8, wherein said another calculating means comprises an adder for adding said delayed correction data to said amount of heat of heating resistors.

10. An apparatus according to claim 8, wherein each of said first delay means and said second delay means comprises a line memory.

* * * * *

UNITED STATES PATENT AND TRADEMARK OFFICE

CERTIFICATE OF CORRECTION

PATENT NO. : 5,115,252

DATED : May 19, 1992

INVENTOR(S) : Eiichi SASAKI

It is certified that error appears in the above-identified patent and that said Letters Patent is hereby corrected as shown below:

Title page, left-hand column, between section [76] and [21], insert --[73] Assignee: Ricoh Company, Ltd., Tokyo, Japan--

Signed and Sealed this

Twentieth Day of May, 1997

*Attest:*

*Attesting Officer*

Bruce Lehman

BRUCE LEHMAN

*Commissioner of Patents and Trademarks*